United States Patent [19]

Lauterjung

[11] 3,952,569

[45] Apr. 27, 1976

[54] METHOD AND APPARATUS FOR COILING LONG PRODUCTS

[75] Inventor: Gunter Lauterjung, Solingen, Germany

[73] Assignee: Firma Friedrich Kocks, Dusseldorf, Germany

[22] Filed: Sept. 11, 1974

[21] Appl. No.: 505,134

[30] Foreign Application Priority Data

Sept. 15, 1973 Germany ..... 2346554

[52] U.S. Cl. ..... 72/134; 72/169; 72/426; 242/83

[51] Int. Cl.[2] ..... B21C 47/00

[58] Field of Search ..... 72/134, 426, 342, 169, 72/128, 171; 242/79, 82, 78, 83

[56] References Cited

UNITED STATES PATENTS

| | | | |
|---|---|---|---|
| 2,712,381 | 7/1955 | Bruestle | 72/342 |
| 2,937,821 | 5/1960 | O'Brien | 72/171 |
| 3,135,477 | 6/1964 | Brown | 242/83 |
| 3,561,694 | 2/1971 | Schuetz | 242/83 |

*Primary Examiner*—C. W. Lanham
*Assistant Examiner*—Gene P. Crosby
*Attorney, Agent, or Firm*—Buell, Blenko & Ziesenheim

[57] ABSTRACT

A method and apparatus are provided for winding long rod-like material, such as tubes, into coils by continuously coiling the material and depositing it into a rotating coiler adapted to collect a selected coil of material and then eject it into a delivery receptacle rotating in substantial synchronism with the coiler, stopping the delivery receptacle for removal of the ejected coil and then reaccelerating the delivery receptacle to substantially the speed of the coiler for receipt of the next completed coil.

13 Claims, 2 Drawing Figures

METHOD AND APPARATUS FOR COILING LONG PRODUCTS

This invention relates to process and apparatus for coiling long products and particularly to a method of winding long rod-like material, such as tubes, into coils, the material to be coiled being bent by means of a bending unit and continuously deposited into a rotating coiler there below.

In a previously preferred method of coiling, it was necessary, on completion of the coiling operation, that is, when the whole of the tube length being coiled is in the coiler, to stop the coiler in order to enable the finished coil to be lifted from the coiler. A method has also been proposed, according to which, when the base of the coiler is raised relative to its side walls while the coiler is stationary, the coil may be pushed upwards out of the coiler and can then be removed to the side and carried away.

A disadvantage of the known methods, however, is that between one coiling operation and the next there is a substantial interval during which tubes cannot be coiled. This is due to the considerable time required to brake the rapidly rotating coiler containing the coiled material to a halt, remove the coil by lifting or pushing, transport it laterally away from the coiler, lower the base of the coiler again, if necessary, and reaccelerate the coiler until its speed of rotation corresponds to the input speed of the next tube. Only then is it possible, using these known methods to initiate a further coiling operation, which of course means substantial interruption of the production and causes particular difficulty when the apparatus is used in association with continuous process equipment.

Such interruptions in operation are obviously quite undesirable and are costly in lost time and labor. Unfortunately however, there was no solution to this problem prior to the present invention.

The applicant, by the present invention, makes it possible to eliminate these costly prior art delays.

It is accordingly a feature of the present invention to provide a method and an apparatus which permit substantially uninterrupted coiling of successive lengths of a material.

According to the present invention, a method is provided for winding long, rod-like material, such as tubes, into coils, in which the material to be coiled is continuously bent and continuously deposited into a rotating coiler below, and in which the completed coil is ejected downwards from the continuously rotating coiler into a delivery receptacle rotating substantially in synchronism with the coiler, whereafter the delivery receptacle is braked, the completed coil is removed, and the delivery receptacle is reaccelerated to the speed of rotation of the coiler, and the material for the next succeeding coil is fed into the coiler during such braking, coil removal and reacceleration.

With this method, the coiler is ready to receive material at particularly any time except during the few seconds interruption at the instant when a coil of tube is ejected. The separate lengths of material to be coiled can follow each other at intervals of approximately 5 seconds, instead of several minutes. The productive capacity of continuously operating equipment serially connected to the apparatus is therefore not restricted by the coiling operation, and the substantial idle time of the prior art practices is reduced to a minimum. Sufficient time is available for braking and restarting the delivery receptacle while the coiling operation in the coiler is still proceeding. Substantial force is therefore not required for braking and starting, such as is necessary in the case of the known method in order to reduce idle time.

The invention also provides an apparatus for winding long rod-like material into coils comprising a unit for bending the material to be coiled, a motor-driven coiler arranged beneath the bending unit and rotatable at a speed corresponding to the speed of input of the material, the coiler being provide with an operable base, and a delivery receptacle, also motor driven and adapted to be rotated substantially in synchronism with the coiler, beneath and coaxially of the coiler for receiving a completed coil discharged through the base of the coiler when opened.

In such apparatus, the removal or opening of the base in the vicinity of the coil enables the latter to be ejected without difficulty into the delivery receptacle provided below. Since the delivery receptable is arranged coaxially of the coiler, the coil retains its compact coil form and does not become jammed during ejection. No additional ejection means are necessary. Since the delivery receptacle rotates in synchronism with the coiler, or, at any rate, since the difference in their speeds is insubstantial, no substantial relative movement takes place between the coil and the delivery receptacle. Handling of the material is therefore light, and wear on the delivery receptacle is reduced.

It is advantageous if the drive to the delivery receptacle is provided with a brake. This reduces the time which would otherwise be required to stop the drive unit and the delivery receptacle merely by switching off the drive.

Basically, the delivery receptacle preferably comprises a circular, substantially horizontal table and one or more means for retaining the coiled material, extending substantially perpendicularly to but being adapted to be lowered relatively to the surface of the table. In an advantageous embodiment of the invention, the retaining means comprise a number of pins arranged about the perimeter in the region of the radially outer rim of the table. A delivery receptacle of such construction is simple, robust and hardwearing. Lowering the retaining means enables the coil to be pushed laterally from the table, for example onto a suitable conveyor arranged level with the table, while the delivery receptacle is stationary. Instead it is of course possible to lower the table and push the coil from the table on a plane below the retaining means. In both cases it is useful if an actuable ram, pivoted arm or the like is provided adjacent to the delivery receptacle and above the surface of the table thereof, for pushing the coil substantially radially from the surface of the table.

In a preferred embodiment of the invention the base of the coiler is provided with flaps, which are operable in association with a power cylinder preferably provided in the region of the axis of rotation of the coiler. The flaps are arranged in the region of that portion of the base which support the coiled material. Such flaps are substantially trouble-free; they can be of sturdy construction and can be manufactured at low cost.

It is particularly advantageous if the partially removable base portions are adapted to transmit torque between the radially inner and the radially outer portions of the coiler. There is then no need for a radial connection between the two portions of the coiler, which would interfere with the feeding and removal of the coiled material.

It is advisable for the retaining means of the coiler, for the radial retention and guidance of the material to be coiled, to be so constructed and arranged that they form an annular receptacle for the material, tapering outwards in the direction of the base of the coiler. Such a receptacle facilitates ejection of the coils by preventing radial jamming of the coils in the receptacle.

In addition, it is possible to provide the retaining means of the coiler, and also the delivery receptacle, if desired, with water-cooled walls for the radial retention and guidance of the coiled material. This feature is of particular importance when coiling material still warm following rolling, or order to prevent undue heating of the coiler and the delivery receptacle.

The invention is further described, by way of example, with reference to the accompanying drawings, in which.

Figure 1:
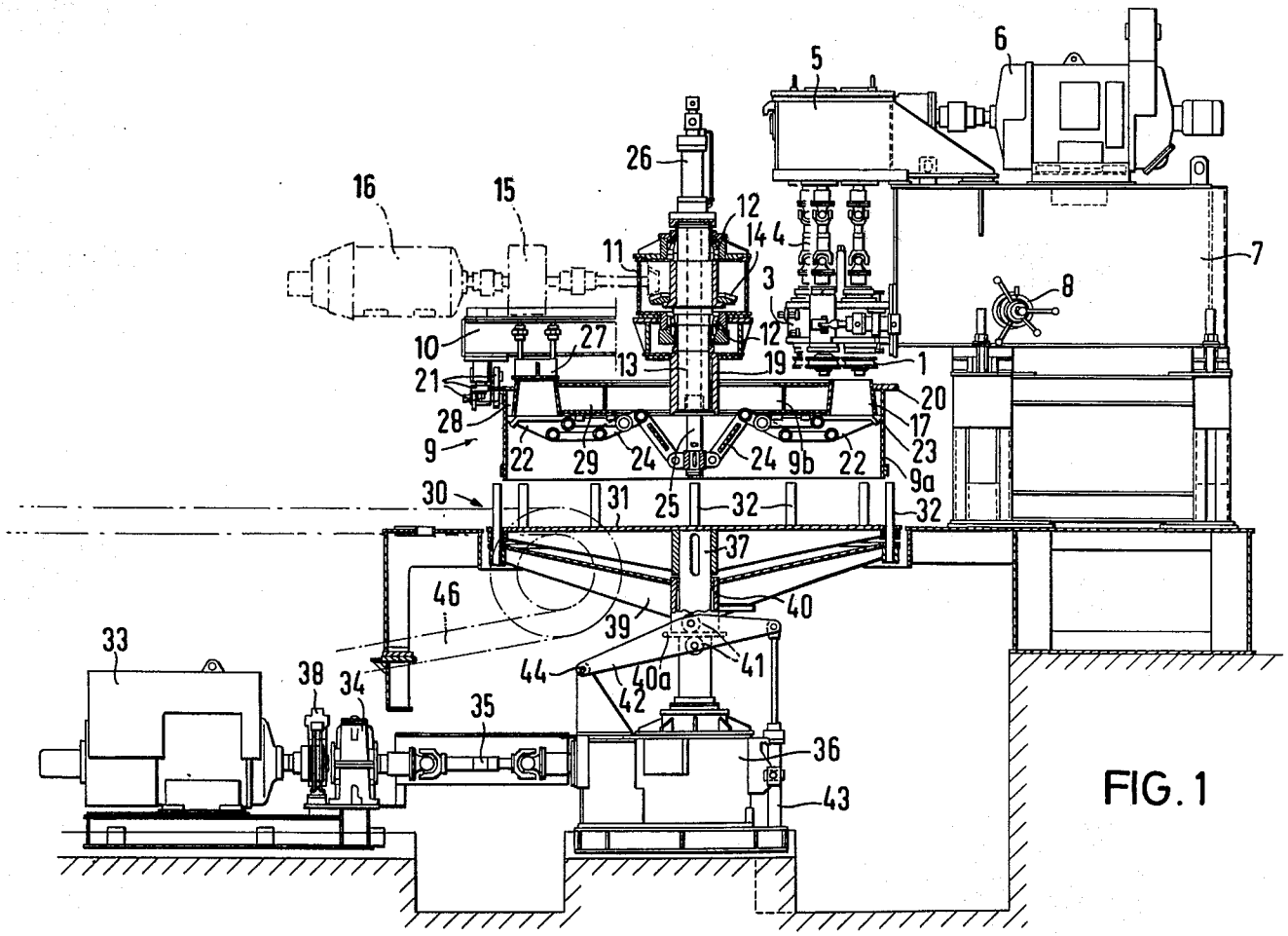
FIG. 1 is a vertical sectional view of an apparatus in accordance with the invention, along the line I—I in FIG. 2.

Referring to the drawings, a bending unit 1 is provided with rollers constructed and arranged so as to bend the long rod-like material, for example, a tube which is fed into the unit in the direction shown by the arrow *x*, and which is to be coiled to a predetermined radius. A feed funnel 2, which is replaceable and is adjustable within certain limits, ensures satisfactory feeding of the material. The rollers of the bending unit 1 are journalled in a housing 3 and are driven by means of a motor 6 via universal joint shafts 4 and a gear-box 5. The driving motor 6 is an easily controllable direct current motor, so that the speed of rotation of the rollers of the bending unit 1 can readily be adjusted to the input speed of the material. The bending unit 1, together with its bearing housing 3 and also its drive 4, 5, 6, is arranged above and to the side of a column 7. Fine adjustment of the bending radius may be achieved by means of a handwheel 8, which effects limited radial adjustment of the bending rollers with respect to the material to be coiled. The upper portion of the column 7 is also capable of limited adjustment on its base in order to vary the bending radius.

A coiler 9 is provided beneath the bending unit 1. The coiler 9 is supported from a cross beam 10, which, for simplicity, is shown only in part in FIG. 1, but which is shown in full in FIG. 2. The cross beam 10 supports a bearing housing 11, having bearings 12, in which the shaft 13 of the coiler 9 is journalled. The bearing housing 11 serves also as a gear housing for a bevel gear drive 14, which is driven by a motor 16 via an intermediate gearbox 15. The motor 16 is also a direct current motor, which is easily controllable and whose speed can accordingly be accurately adjusted to the input speed of the material.

The rotating coiler 9, driven by the motor 16 and attached to the shaft 13, is provided with an annular receiving chamber 17 for the material to be coiled, the chamber 17 having cross-sectionally an outward taper towards its bottom end. The chamber 17 is formed by a radially outer portion 9*a* and a radially inner portion 9*b* of the coiler 9. The radially inner portion 9*b* is connected by means of spoke-like member 18 via a hub 19 directly to the shaft 13, by means of which they are supported and driven. The radially outer portion which is separate from the inner portion 9*b* is provided with a guide rim 20, which runs between guide rollers 21 provided on the cross beam 10 or of a member 10*a* of the cross beam and spaced about the periphery of the coiler 9, the guide rollers are not driven: thus the radially outer portion 9*a* of the coiler 9 is merely supported and guided by the rollers. The outer portion 9*a* is, however, driven via flaps 22, which also form the base of the coiler 9, in the region of the receiving chamber 17. The flaps 22 are held in engagement at 23 with the outer portion 9*a* of the coiler 9 by pressure, and the outer portion 9*a* is thus driven by means of the resulting friction. The flaps 22 can be pivoted through rather more than 90°, thus completely opening the base of the receiving chamber 17. Pivoting of the flaps 22 to the position shown in broken lines is performed by means of a lever system 24. The lever system 24 is operated by means of a lifting rod 25, which extends through a longitudinal bore in the shaft 13 and which can be actuated by means of a power cylinder 26 provided on the top of the bearing housing 11.

The top of the receiving chamber 17 is open only in the region of the bending unit 1, and can be closed in the region of the remainder of its perimeter. It is also possible to leave the chamber substantially open in the region of these peripheral areas, and simply provide a plurality of holding means 27 at intervals in order to prevent the material being coiled from lifting upwards out of the receiving chamber 17. The holding means 27 may be water-cooled or they may serve to retain water nozzles which subject the material itself to water cooling. The side walls of the receiving chamber 17 may also be water-cooled, cooling water being admitted to the chambers 28 and 29, and connections (not shown) being provided for replenishment of the cooling water.

When the flaps 22 are opened, the coil drops into a delivery receptacle 30 arranged beneath and coaxially of the coiler 9. The delivery receptacle 30 comprises a circular table 31, in the region of whose radially outer rim retaining pins 32 are arranged at intervals about the perimeter. The delivery receptacle 30 may be provided with a water cooler (not shown), for further cooling the coiled material. The table 31, together with the retaining pins 32, is driven by a motor 33, which, for control reasons, is also a direct current motor. The central driving shaft 37 of the table 31, on which the table 31 is also mounted, is driven via an intermediate gearboox 34, a universal joint shaft 35 and a bevel wheel drive 36. A brake 38 is provided between the motor 33 and the intermediate gearbox 34 in order to enable the delivery receptacle 31 to be stopped more quickly.

The retaining pins 32 can be lowered relatively to the table 31. This lowering is performed by means of supporting arms 39, which are attached to a common hub 40, and to which the pins 32 are fixed. The hub 40 is axially movable on the shaft 37, but rotates with the shaft. It has a rim 40*a*, which is engaged above and below by guide rollers 41. The guide rollers 41 are journalled to a control lever 42, one end of which can be raised or lowered by means of a power cylinder 43, the other end of the control lever 42 being retained by a hinged support 44. It is thus possible to raise or lower the retaining pins 32 by operating the cylinder 43.

Figure 2:
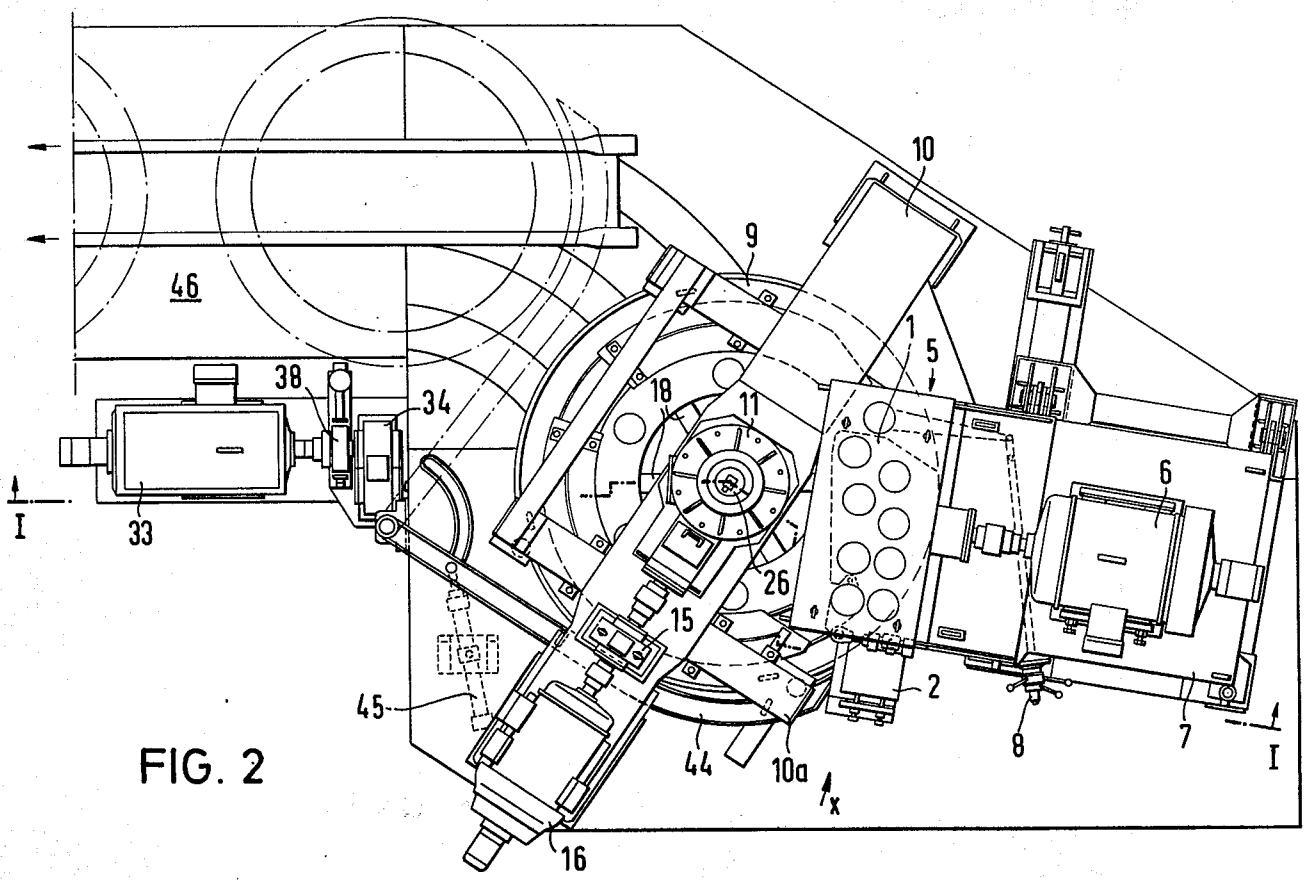
FIG. 2 is a plan view of the apparatus in accordance with the invention, as shown in FIG. 1.

Shortly before the whole of the length of material being coiled is delivered into the receiving chamber 17 of the coiler 9, and while the coiler 9 is rotating at a speed corresponding to the input speed of the material, the delivery receptacle 30 also rotates at the same speed. When the coiling operation is completed, the flaps 22 are opened, and the coil drops out of the receiving chamber 17 onto the delivery receptacle 30, following which the flaps 22 are immediately closed again in order to receive the next length of material to be coiled. The delivery receptacle 30 is then braked to a halt by the motor 33 with the aid of the brake 38. When the cylinder 43 is actuated, the pins 32 are lowered to their bottom positions, shown in broken lines, so that the coil lies unobstructed on the table 31. A pivoted arm or lever 44*a*, actuated by means of a power cylinder 45, both of which are shown in FIG. 2, pushes the coil in a radial direction from the table 31 onto a conveyor 46, which removes the coil. After the return of the pivoted arm 44*a* to its initial position, the delivery receptacle 30 is reaccelerated until it reaches the speed of the coiler 9. The retaining pins 32 are also raised, so that the delivery receptacle 30 is ready to receive the next finished-formed coil.

Instead of the pivoted arm 44*a*, other pushing means such as a ram, can be provided for pushing the finished coil from the table 31.

While certain preferred practices and embodiments of this invention have been set out and disclosed in the foregoing specification, it will be understood that this invention may be otherwise embodied within the scope of the following claims.

I claim:

1. A method of winding long, rod-like material, such as tubes, into coils comprising the steps of continuously bending the material to be coiled, continuously depositing the bent material into a rotating coiler, collecting the bent material on the coiler until a preselected size coil has been accumulated, ejecting the completed coil downwardly from the continuously rotating coiler into a delivery recepticle rotating substantially in synchronism with the coiler, while maintaining the rotating speed of said coiler, reducing the speed of the delivery receptacle, removing the completed coil from the delivery receptacle, and reaccelerating the delivery receptacle to the speed of rotation of the coiler while feeding material for the next succeeding coil into the coiler during such speed reduction, coil removal and reacceleration.

2. The method of winding long rod-like material as claimed in claim 1 wherein the delivery receptacle is stopped prior to removal of the completed coil.

3. The method of winding long rod-like material as claimed in claim 1 wherein the rod-like material is continuously bent above the rotating coiler and is deposited downwardly into the coiler.

4. Apparatus for winding long rod-like material into coils comprising a unit for bending the material to be coiled, a motor-driven coiler arranged beneath the bending unit and rotatable at a speed corresponding to the speed of input of the material for coiling a complete coil of rod-like material ready for cutting and removal from the coiler, a removable base on said coiler, means for selectively removing said base, and a delivery receptacle adapted to be rotated substantially in synchronism with the coiler, beneath and coaxially of the coiler for receiving a completed coil discharged through the base of the coiler when said base is removed.

5. Apparatus as claimed in claim 4 in which a brake is provided for the delivery receptacle.

6. Apparatus as claimed in claim 4 in which the coiler comprises separate radially inner and outer portions and in which the removable base of the coiler which is displaceable to open the coiler is adapted to transmit the torque between the radially inner and the readily outer portions of the coiler.

7. Apparatus as claimed in claim 4 in which the coiler has an annular receiving chamber for the retention and guidance of the material to be coiled, said receiving chamber having an outward taper in a direction towards the base of the coiler.

8. Apparatus for winding long rod-like material into coils comprising a unit for bending the material to be coiled, a motor-driven coiler arranged beneath the bending unit and rotatable at a speed corresponding to the speed of input of the material, a removable base on said coiler, means for selectively removing said base, and a delivery receptacle adapted to be rotated substantially in synchronism with the coiler, beneath and coaxially of the coiler for receiving a completed coil discharged through the base of the coiler when said base is removed, and in which the base of the coiler is provided with flaps which are actuable in common by means of a power cylinder to open the base.

9. Apparatus as claimed in claim 8 in which the power cylinder is arranged in the region of the axis of rotation of the coiler.

10. Apparatus for winding long rod-like material into coils comprising a unit for bending the material to be coiled, a motor-driven coiler arranged beneath the bending unit and rotatable at a speed corresponding to the speed of input of the material, a removable base on said coiler, means for selectively removing said base, and a delivery receptacle adapted to be rotated substantially in synchronism with the coiler, beneath and coaxially of the coiler for receiving a completed coil discharged through the base of the coiler when said base is removed, in which the delivery receptacle comprises a circular, substantially horizontal table and one or more retaining means for the coils, extendinng substantially perpendicularly to, but being adapted to be lowered relatively to the surface of the table.

11. Apparatus as claimed in claim 10, in which the retaining means comprise a plurality of pins arranged at intervals about the perimeter of the table in the region of the outer rim of the table.

12. Apparatus as claimed in claim 10, in which means are provided adjacent to and above the surface of the delivery receptacle for pushing the finished coil substantially radially from the surface of the table.

13. Apparatus as claimed in claim 12 in which said pushing means comprises a pivoted arm.

* * * * *